US009782048B2

(12) United States Patent
Witter et al.

(10) Patent No.: US 9,782,048 B2
(45) Date of Patent: Oct. 10, 2017

(54) VACUUM ASSIST SCRAPER TOOL

(71) Applicants: Robert M. Witter, Englewood, FL (US); Jeffrey Hill, Cicero, NY (US); John J. Fitzsimmons, Clay, NY (US)

(72) Inventors: Robert M. Witter, Englewood, FL (US); Jeffrey Hill, Cicero, NY (US); John J. Fitzsimmons, Clay, NY (US)

(73) Assignee: Oneida Air Systems, Inc., Syracuse, NY (US)

( * ) Notice: Subject to any disclaimer, the term of this patent is extended or adjusted under 35 U.S.C. 154(b) by 0 days.

(21) Appl. No.: 15/068,728

(22) Filed: Mar. 14, 2016

(65) Prior Publication Data

US 2016/0270612 A1 Sep. 22, 2016

Related U.S. Application Data

(60) Provisional application No. 62/134,660, filed on Mar. 18, 2015.

(51) Int. Cl.

| | |
|---|---|
| ***A47L 9/06*** | (2006.01) |
| ***A47L 13/08*** | (2006.01) |
| ***B44D 3/16*** | (2006.01) |
| ***A47L 7/00*** | (2006.01) |
| *A47L 13/022* | (2006.01) |
| *B08B 1/00* | (2006.01) |

(52) U.S. Cl.

CPC ..... *A47L 9/06* (2013.01); *A47L 7/009* (2013.01); *A47L 9/0626* (2013.01); *A47L 13/08* (2013.01); *B44D 3/164* (2013.01); *A47L 9/0606* (2013.01); *A47L 13/022* (2013.01); *B08B 1/005* (2013.01)

(58) Field of Classification Search

CPC ..... B44D 3/164; B08B 1/005; B08B 9/0808; A47L 9/06; A47L 9/0808; A47L 9/0626; A47L 13/08; A47L 13/022

USPC ..... 15/401, 402

See application file for complete search history.

(56) References Cited

U.S. PATENT DOCUMENTS

| | | | | |
|---|---|---|---|---|
| 1,782,882 | A * | 11/1930 | Rippey | A47L 9/02 15/412 |
| 6,070,292 | A | 6/2000 | Langelaan | |
| 6,601,266 | B1 | 8/2003 | Faraci et al. | |
| D540,994 | S | 4/2007 | Borges | |
| 7,805,805 | B2 * | 10/2010 | Loveless | A47L 9/06 15/246.2 |
| 7,814,609 | B1 | 10/2010 | Shumway | |
| 8,069,531 | B2 | 12/2011 | Ruston | |
| D659,315 | S | 5/2012 | Hollis et al. | |

* cited by examiner

*Primary Examiner* — David Redding

(74) *Attorney, Agent, or Firm* — Bernhard P. Molldrem, Jr.

(57) ABSTRACT

An ergonomic vacuum-assist scraper tool has an arcuately curved head in which a scraper blade is mounted at either of a front position or a rear position, a handle or grip portion, and a tubular connector portion adapted to receive a male or female vacuum hose fitting. The head has a cavity defined between front and back walls, with the front and back walls converging along an arc to a mouth or slot opening. The grip portion is hollow and tubular, extending proximally from the head, to the vacuum hose-accepting tubular connector. A scraper blade can be removably mounted at either of the blade mounting positions. The tool is formed of upper and lower halves that snap together along a partition line.

14 Claims, 12 Drawing Sheets

VACUUM ASSIST SCRAPER TOOL

Applicants claim priority of their Provisional Patent Application 62/134,660, filed Mar. 18, 2015, the contents of which are incorporated by reference herein.

BRIEF DESCRIPTION OF THE INVENTION

This invention is directed to hand-held scraper tools, with a handle or grip portion, a head at one end that holds one or more scraper blades, and which can be used, for example, in cabinetmaking, carpentry and similar trades, for removing old paint or varnish from a work surface, or can be used to remove other substances including irregularities in the material itself.

The invention is also directed to a scraper tool in which process dust from the scraper action is directed from the scraper to dust collection storage equipment.

In particular, this invention concerns a vacuum-assist scraper in which there is a tubular passage or channel in the grip or handle with a mouth or slot opening in the head near the scraper blade, and a tubular connector at the end of the grip or handle opposite the head to attach to the hose of a shop vacuum cleaner or other dust collection equipment. This arrangement helps collect and remove the dirt and scrapings from the work surface and also reduces the airborne dust in the work area.

It has been desired to create an improved vacuum-assisted scraping tool with features to optimize the scraping process and also to improve the air flow through the tool to increase dust removal efficiency.

It is a significant object to provide a simplified scraping tool of a straightforward design with improved vacuum efficiency of dust collection.

It is a more specific object for the tool design to accept any of a number of common vacuum hose sizes, with the vacuum outlet of the tool being configured to accept either male or female hose connectors.

It is another object to accept the common and readily available scraper blades to be mounted at any of several blade locations on the head of the tool: at the front face of the head for minimum clearance between the scraper head and vertical walls for close work near the edge of a floor, stair tread, or other horizontal surface; at the inside wall of the front face, achieving maximum strength and rigidity while optimizing airflow past the scraper blade; and at the back (proximal) side of the back wall of the head, which position can be used for mounting secondary, angled "putty-knife" type scraper blades.

A large number of blade options are possible, including tungsten carbide (WC) blades, either straight or curved-edge blade, of standard sizes (typically 50 mm or 60 mm width). Other possible blades include hardened steel flat blades, spark-proof flat or formed blades; bronze alloy blades; ceramic blades; or non-scratching brass blades (for use on glass). Formed blades of a variety of shapes and purposes can attach at the rear mount position, e.g., formed or bent putty-knife type scraping blades, which may be steel, brass, ceramic or plastic. Squeegee blades can be mounted at any of the three positions for picking up liquids or wet materials, in either a push mode or a pull mode.

Special-purpose blades, such as abrasive or non-abrasive brushes, e.g., for scrubbing or polishing, may be mounted on the tool, and may be made of natural bristle, synthetic (e.g., plastic) bristle, or metal bristle. Comb or brush attachments can be used for removing pet hair or for purposes such as carpet cleaning.

The tool body is of a two-piece construction, with upper and lower halves that snap together and screw together, and with shouldered seams to minimize air leakage at the partitions between the two halves. The two halves are well secured because both screw connectors and snap-together joints are used.

A weakly conductive plastic material in the tool dissipates any static charge build up, with the charge passing out via anti-static vacuum hoses or other suitable grounding means.

The tool handle or grip portion has improved ergonomic design for better grip and reduced user fatigue.

A hang-up hole at the proximal (i.e., rear or suction hose) end of the tool facilitates tool storage and improved tool organization. The hole is positioned on a tab that extends back from the proximal end of the tubular connector, and follows the curve of the connector portion so as not to interfere with fitting of either a male or female vacuum hose fitting.

Many possible variations of this inventive feature are possible that would follow the same basic principles. The scraper tool can be of another configuration, e.g., rectangular or oval in section. The scraper tool can be used with either cyclonic or non-cyclonic dust collector systems.

BRIEF DESCRIPTION OF THE DRAWING

An illustrative embodiment is depicted in the accompanying Drawing Figures.

DESCRIPTION OF A PREFERRED EMBODIMENT

Figure 1:
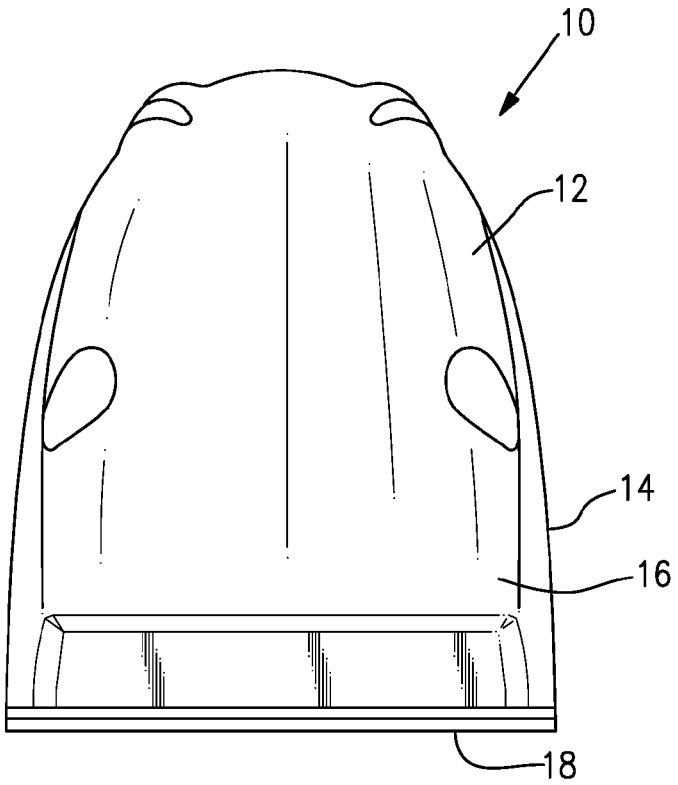
FIG. 1 is a front or distal-end elevation, i.e., head-and-scraper-blade-end elevation, of the scraper tool according to one illustrative embodiment.
Figure 2:
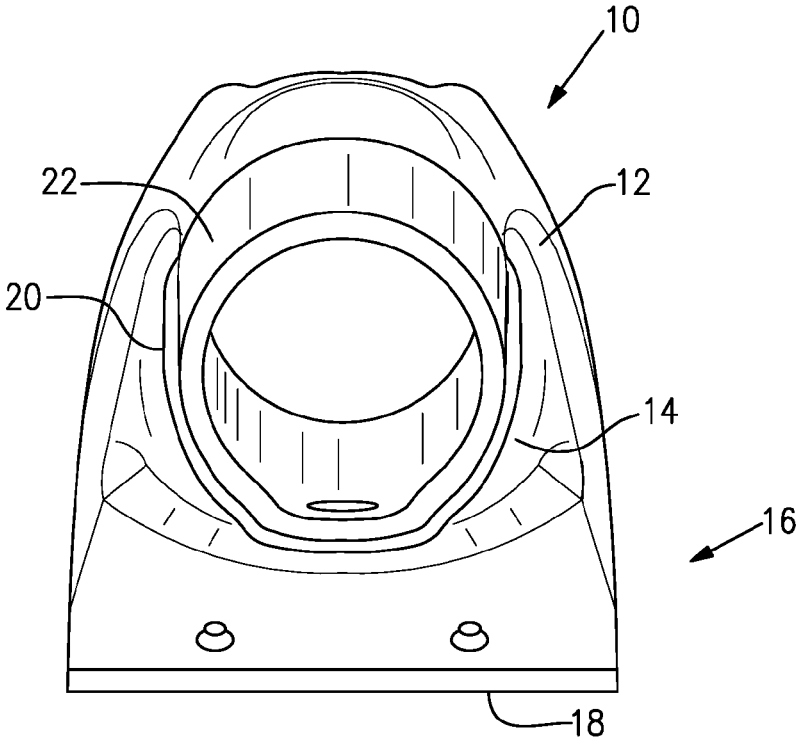
FIG. 2 is a rear or proximal end (vacuum hose connector end) elevation thereof.
Figure 3:
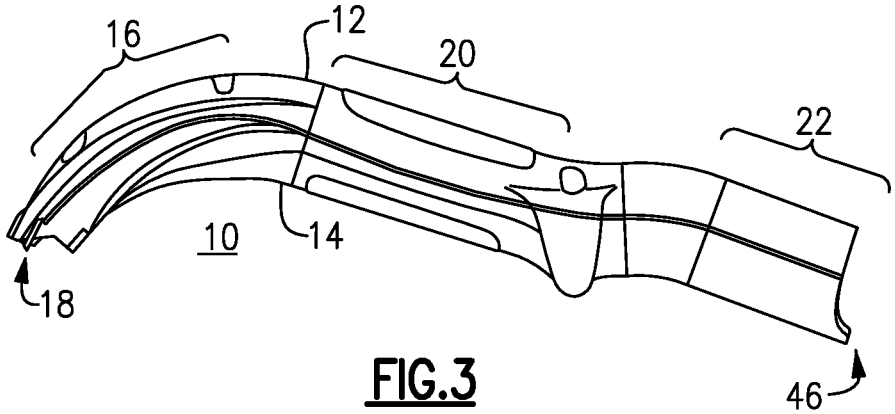
FIG. 3 is a side elevation thereof.
Figure 4:
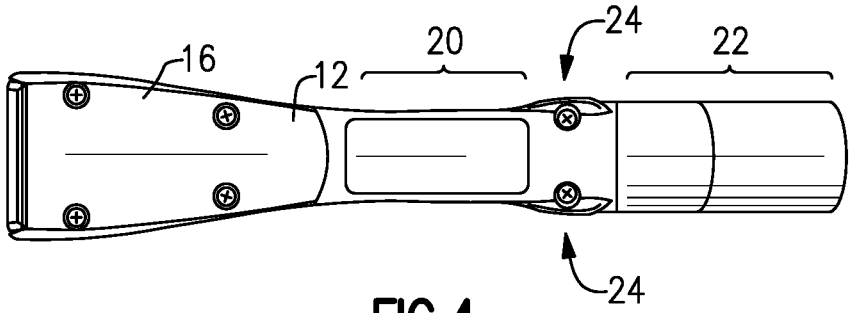
FIG. 4 is a top plan view thereof.
Figure 5:
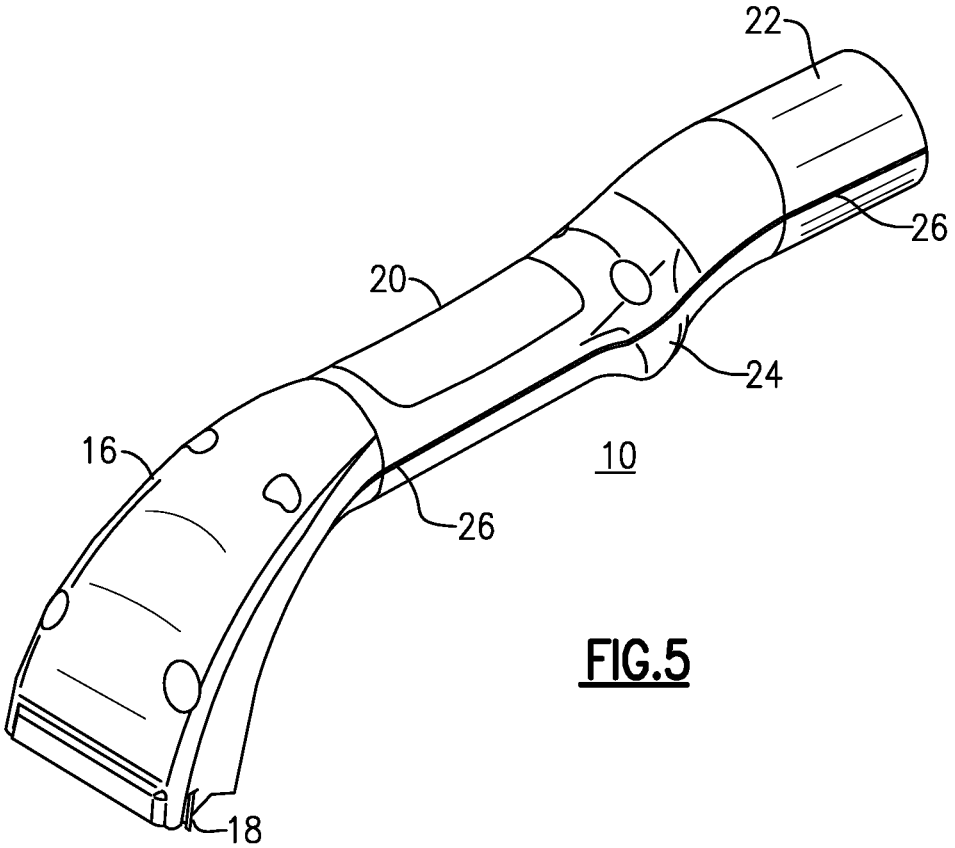
FIG. 5 is a perspective view thereof from distal and to the left.
Figure 6:
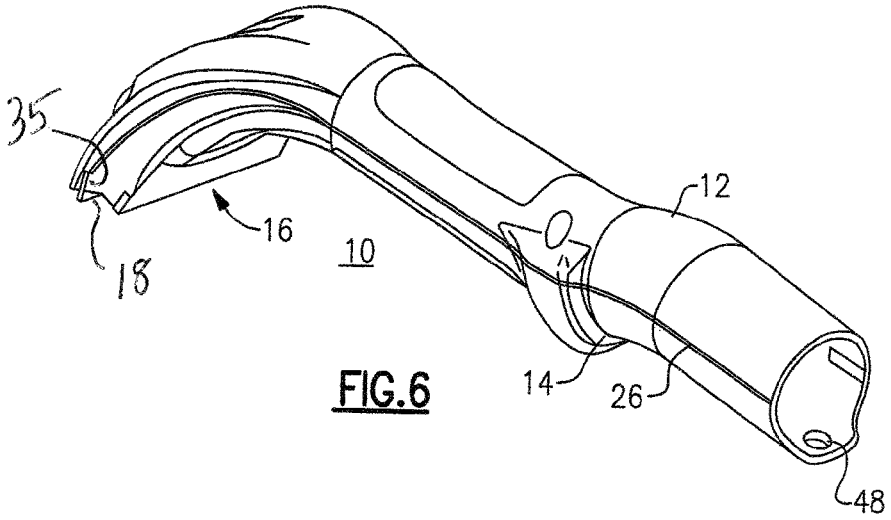
FIG. 6 is a perspective view thereof from proximal and to the left.

With reference to the Drawing Figures, and initially to FIGS. 1 to 6, a vacuum-assist scraper 10 is formed of a molded upper half 12 and a mating molded lower half 14. At one end, i.e., at its distal end the tool has a scraper head 16 which holds a scraper blade 18. The side profile of the head 16 curves continuously in an arc from an axis of the tool, and does not flatten out. Behind the head 16 is a handle or grip portion 20, which is a hollow tubular section of the scraper tool. A tubular vacuum connector 22 projects proximally from the end of the grip portion 20, and serves to receive a suction hose of vacuum hose. As seen in FIGS. 3 to 5, a pair of protuberances 24 bulge outward approximately from the junction of the grip or handle portion 20 and the tubular connector 22, and these serve to create a more ergonomic shape at the proximal end of the handle portion 20 to assist in gripping the tool.

A partition line 26 is shown where the upper half 12 is fitted onto the lower half 14. At the partition line 26 one half, e.g., the upper half 12 may have a ridge or bead extending along it, while the other half, e.g., lower half 14, has a corresponding groove that the ridge or bead fits into (see FIG. 11).

An inlet slot or mouth 28 is formed at the lower and distal end of the head 16, the mouth 28 being defined between front and back walls of the head, and this is also the position for mounting the scraper blade 18 or blades.

Figure 7:
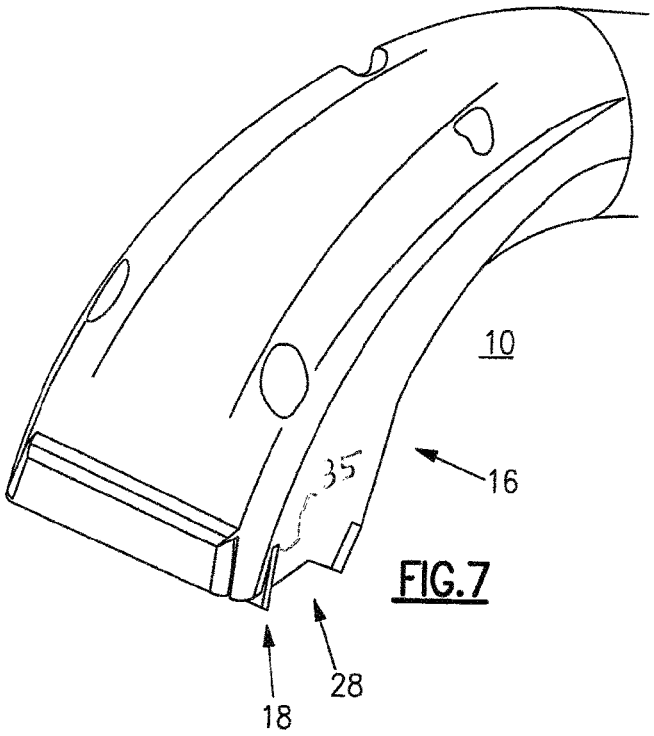
FIG. 7 is a perspective view of the head portion thereof.
Figure 8:
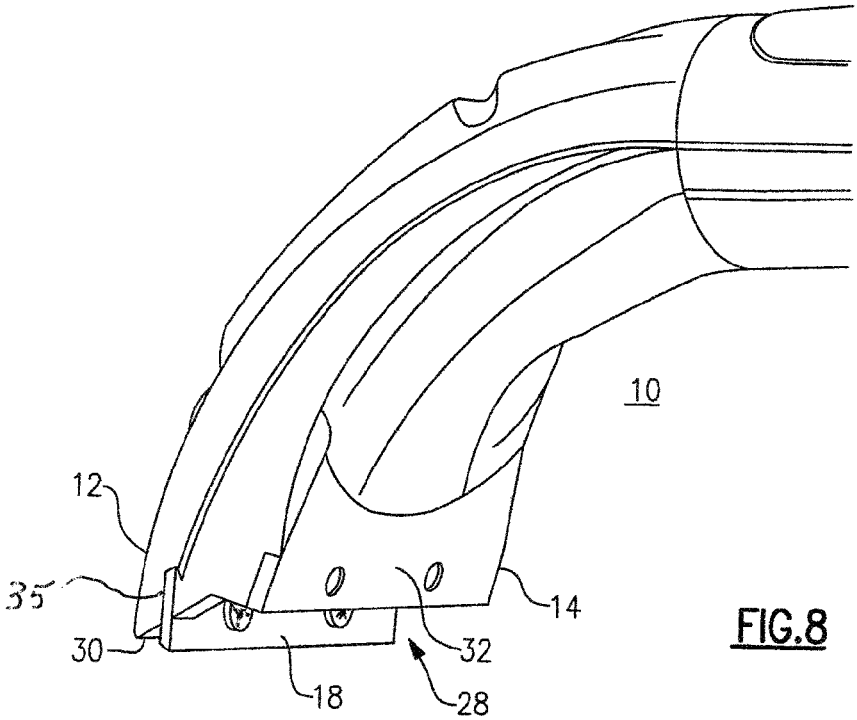
FIG. 8 is a rear perspective view of the head portion thereof.

FIGS. 7 and 8 show the scraper blade 18, here a standard flat tungsten carbide blade, mounted in a front mount position 30 within the mouth 28 of the scraper head, and against the back side of the front wall of the scraper. This positions the scraper blade adjacent the air flow through the inlet slot 28. The scraper blade has two standard screw openings (not shown) and here is mounted to the scraper mounting position 30 with standard (not-numbered) screws. Also shown here is a rear mounting position 32 on the proximal side of the back wall. Threaded openings are visible in FIG. 8. Adjacent the mouth 28 the edge of the upper half 12 has a recess to define a blade support slot 35 on each side of the tool at the mouth 28. These blade support slots 35 support left and right ends of the blade 18 when it is mounted in the front position.

Figure 9:
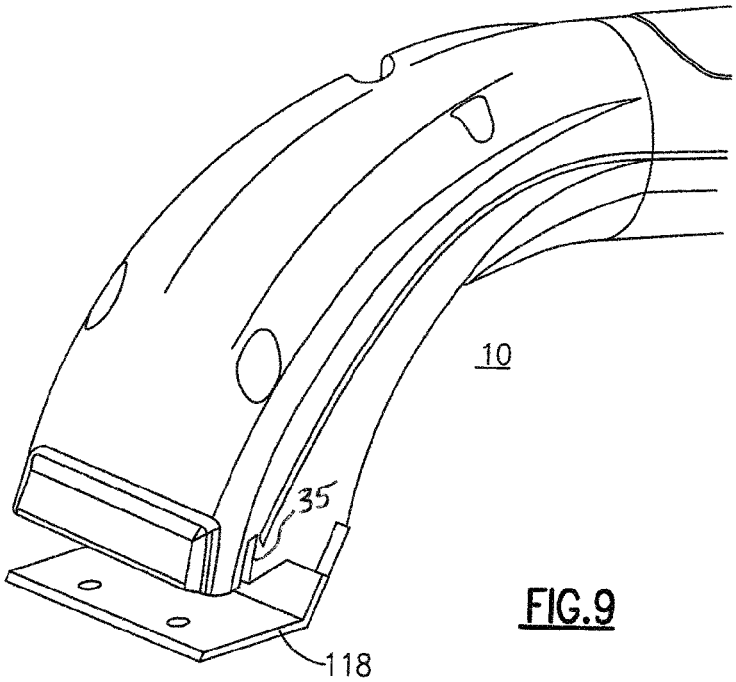
FIG. 9 is a front perspective of the head portion, showing an alternative scraper blade mounted thereon.
Figure 10:
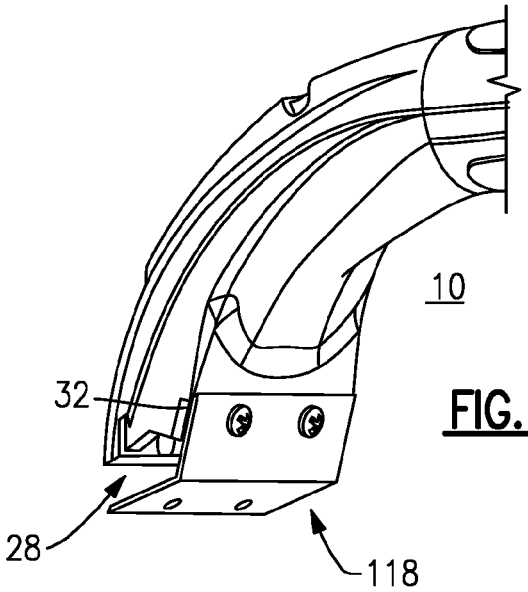
FIG. 10 is a rear perspective of the scraper head portion as configured in FIG. 9.

FIGS. 9 and 10 illustrate an alternative configuration of the scraper 10, here with an alternate blade 118, in the form of a bent or angled scraper blade, which can be used, e.g., for scraping drywall compound. Here, the blade 118 is mounted to the rear mounting position 32 on the proximal or outside surface of the back wall of the head 16. As shown, the bent scraper blade has a scraping edge on a lower portion, a bend, and an upper portion across the bend from the lower portion. There is a pair of mounting apertures on the upper portion, permitting the bent scraper blade to be mounted at the rear mounting position. Here the lower portion extends horizontally, i.e., proximal-distal at least partway across the intake slot.

Figure 11:
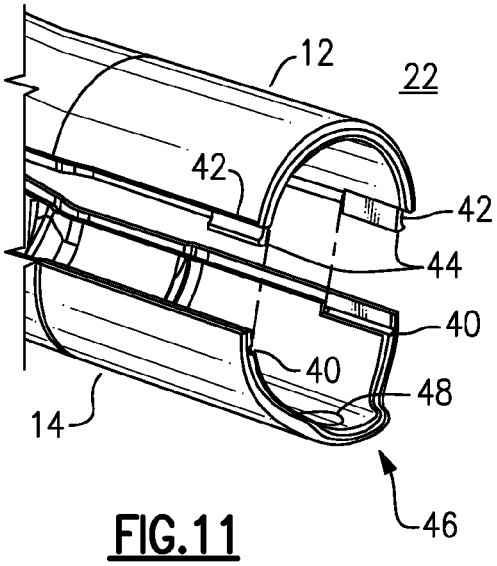
FIG. 11 is an exploded view of a proximal portion of the scraper tool illustrating the snap-together cleat and groove feature of this embodiment.
Figure 12:
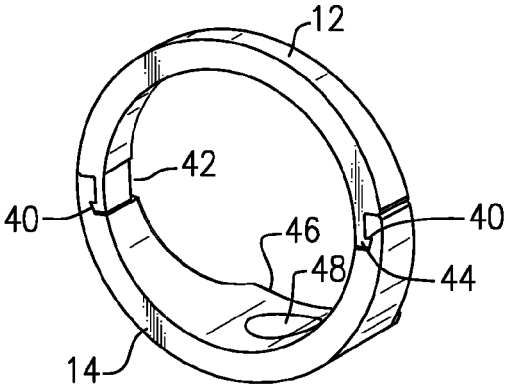
FIG. 12 is a detail view of the proximal end portion of this embodiment.

FIG. 11 illustrates a snap-together fastener feature, found at the proximal end of the vacuum connector 22, although the same or similar fastener structure could be used at other locations on the upper and lower halves 12 and 14, if desired. There are a pair of longitudinal slots 40 or recesses located in the lower half 14 adjacent a proximal end of the connector 22 and at or near the top edge or partition line 26. There are a corresponding pair of tabs or cleats 42 mounted on opposite edges of the upper half 12 at the proximal end of the connector 22, each with a flange 44 that snaps into place within an associated one of the two slots 40. These hold the two halves 12 and 14 securely together. Also a tab 46 projects proximally or back from the end of the connector 22 on the lower half 14. This tab 46 has a hanging hole 48 so that the scraper tool 10 can be hung from a peg or hook when not in use, thus facilitating organization and storage of the user's tools. Also, the tab 46 follows the curve of the outer and inner surfaces of the connector 22, so that the tab does not interfere with placement of either a male hose fitting or female hose fitting on the tubular connector 22. FIG. 12 illustrates the snap-together feature as found in the assembled scraper tool 10, here showing the flanges 44 fitted into the slots or recesses 40 to hold the proximal ends of the two halves together securely.

Figure 13:
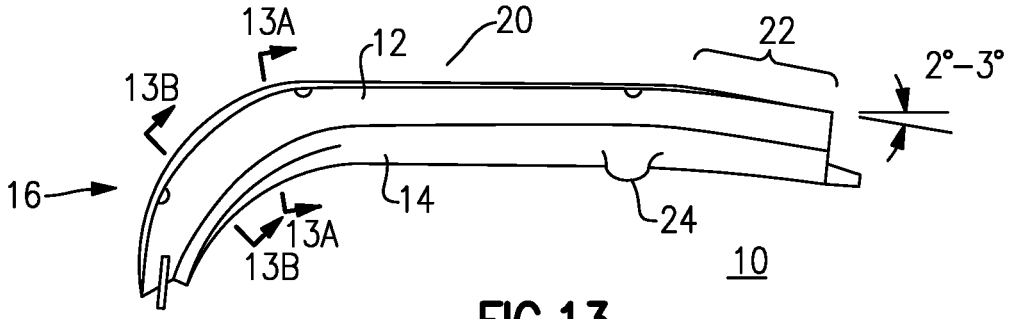
FIG. 13 is a side elevation of this embodiment.
Figure 13A:
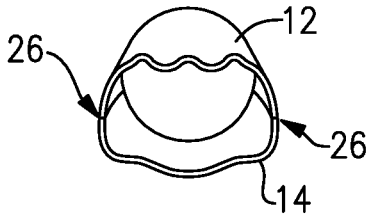
FIGS. 13A and 13B are cross-sections taken at lines 13A-13A and 13B-13B, respectively.
Figure 13B:
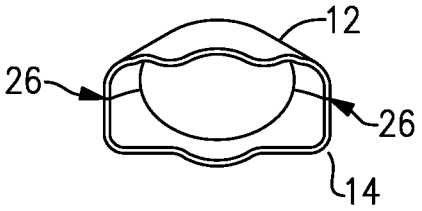

FIG. 13 shows a side profile of the scraper 10 with the head 16 to the left and the connector 22 to the right. As illustrated, the connector 22 is angled or depressed downward relative to the axis of the handle or grip 20 of the tool. FIGS. 13A and 13B illustrate the arcing or curved rib structure in the housing of the head 16. The head has rounded front and rear outside and inside surfaces, at the center of each of the front and back and also at left and right sides of the front and back walls. The front and back walls converge toward the slot opening, or rather diverge from the slot opening towards the tubular handle or grip.

Figure 14:
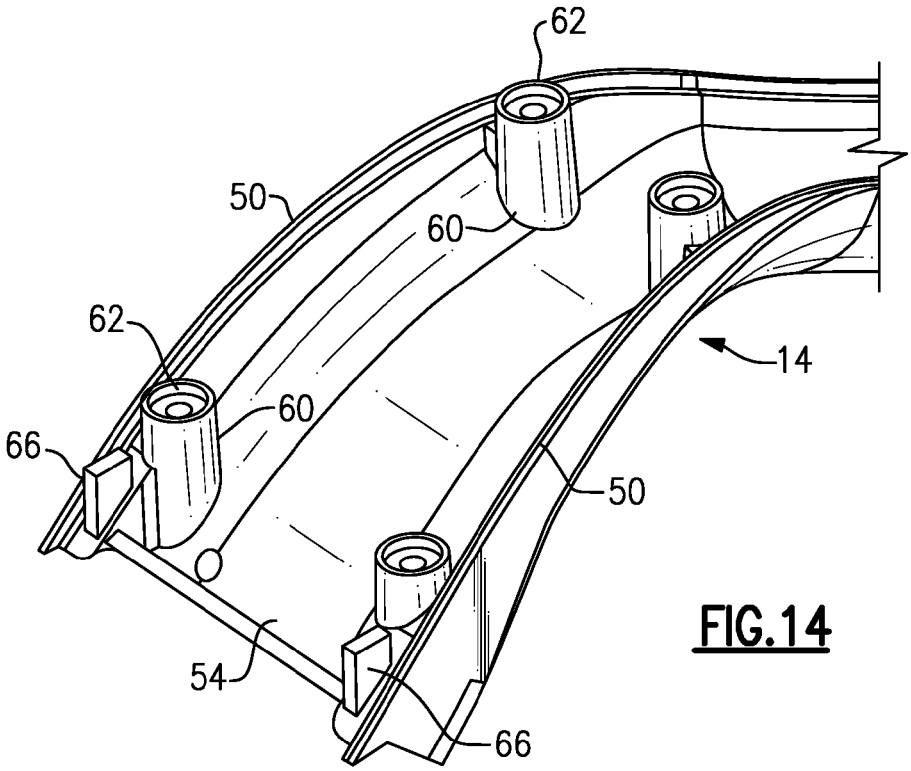
FIGS. 14 and 15 are perspective views of the lower half and upper half of the tool, showing the head portion thereof.
Figure 15:
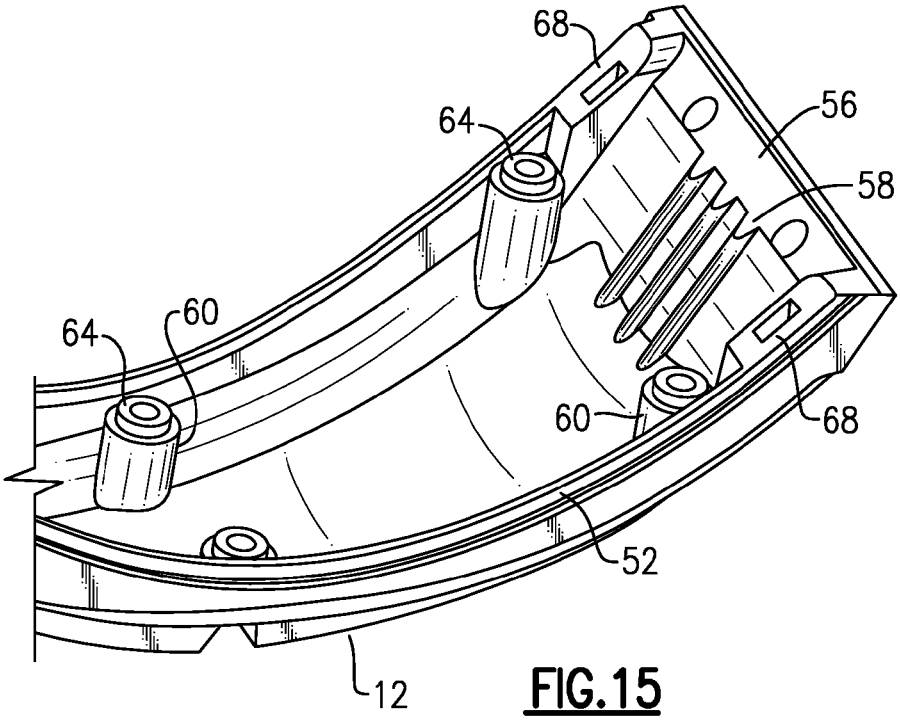
Figure 16:
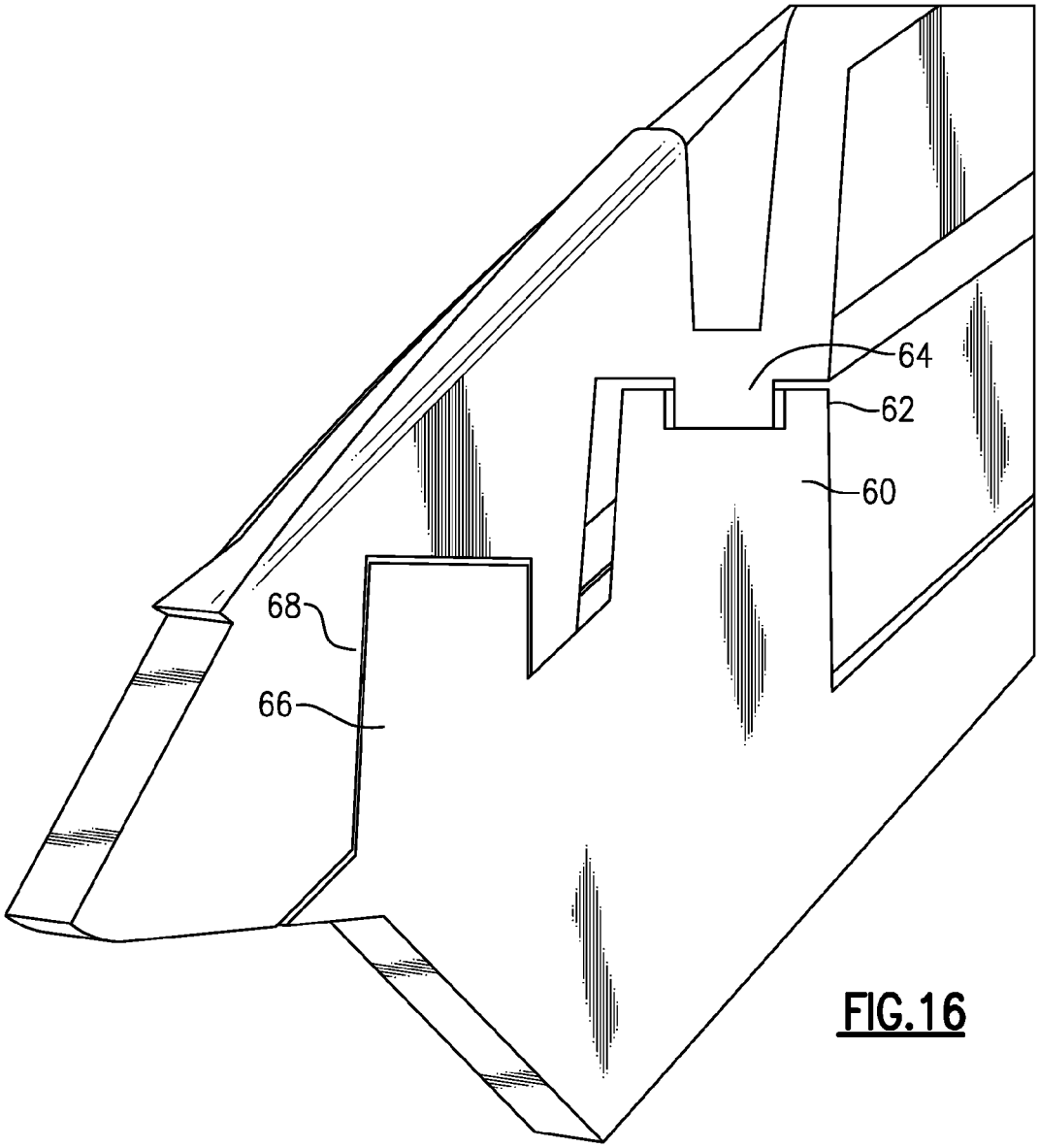
FIG. 16 is a cross section of a portion of the head, illustrating plug and socket construction thereof.

FIGS. 14, 15, and 16 show details of the upper and lower molded halves 12 and 14. The lower half 14 (FIG. 14) has a shoulder or flanged edge 50 that defines the partition 26, while the upper molded half 12 (FIG. 15) has a mating shoulder or rib edge structure 52. The two edges 50 and 52 close together when the tool is assembled, and minimize air leakage through the sides of the tool.

A back wall 54 of the head 16 is shown extending to the slot opening in lower half 14, and a front wall 56 is shown in the upper half (FIG. 15) also extending to the slot opening. The front wall 56 in this embodiment has a number of parallel longitudinal ribs 58, which assist in directing air flow and avoiding turbulence in the air intake through the slot opening 28.

The interior of the upper and lower halves 12 and 14 have molded-in screw post structures 60 to permit fastening the two halves together with threaded fasteners (not shown here). On the lower half 14 (FIG. 14) the post structures have socket members 62 to receive mating plugs 64 found on the screw post structures of the upper half (FIG. 15). These posts have screw holes or openings for receiving the threaded fasteners. The socket and plug structure achieves a sturdy mechanical connection between the two halves 12 and 14. Also as shown here, there are rectangular plug members 66 (FIG. 14) adjacent the distal end of the lower half, i.e., adjacent the slot opening 28, and the upper half 12 (FIG. 15) has mating sockets or recesses 68 at similar locations in the distal end thereof. The plugs and sockets as discussed fit into one another as illustrated in FIG. 16.

Figure 17:
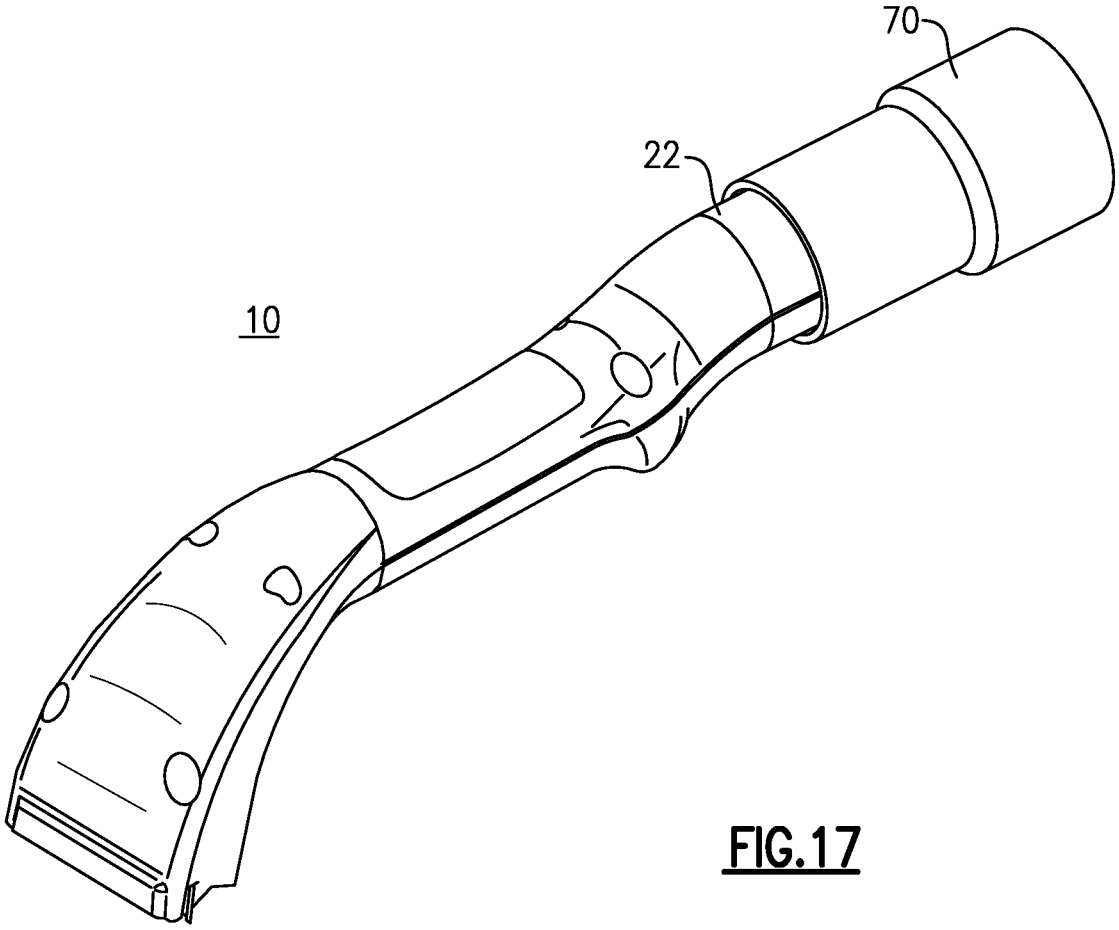
FIG. 17 is a perspective view of the tool and illustrating a female vacuum coupling attached onto the tool.
Figure 18:
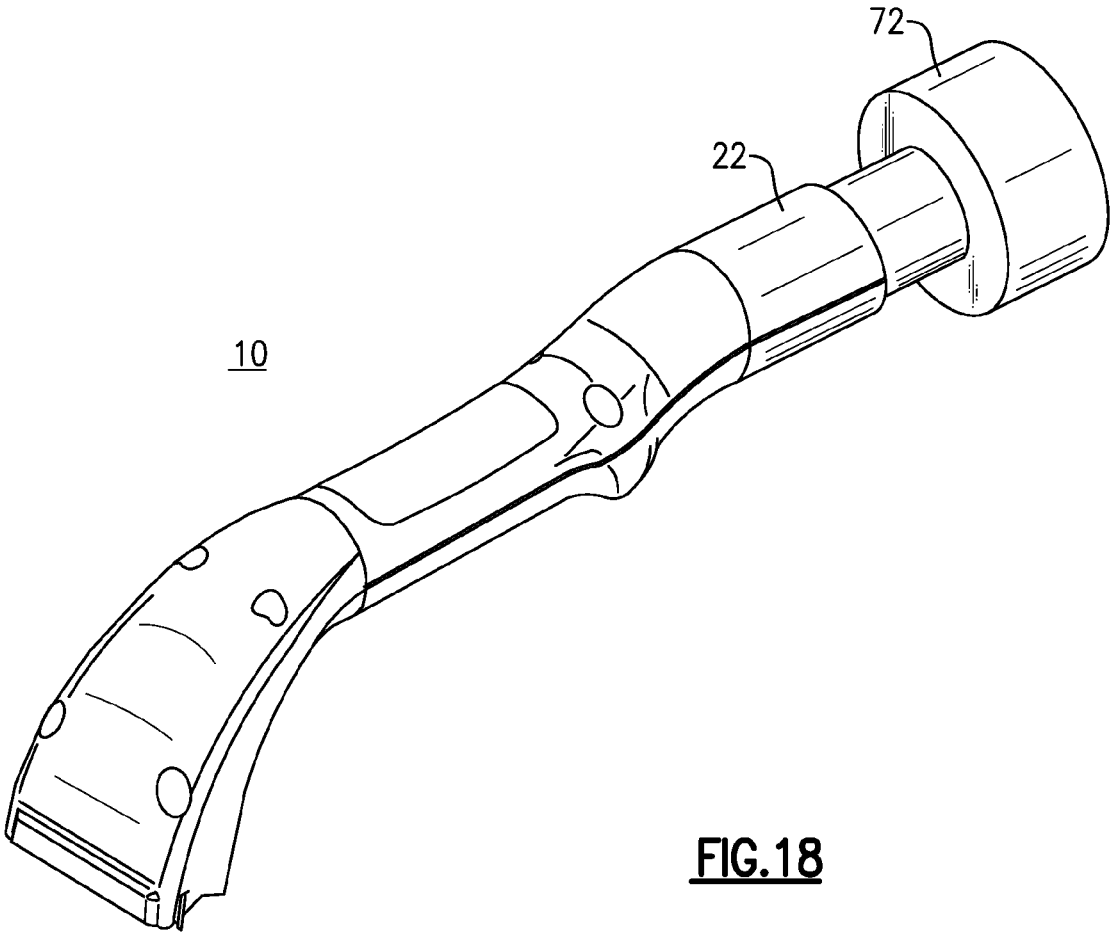
FIG. 18 is a perspective view of the scraper tool and illustrating a male vacuum hose connector inserted into the tubular connector of the tool.
Figure 19:
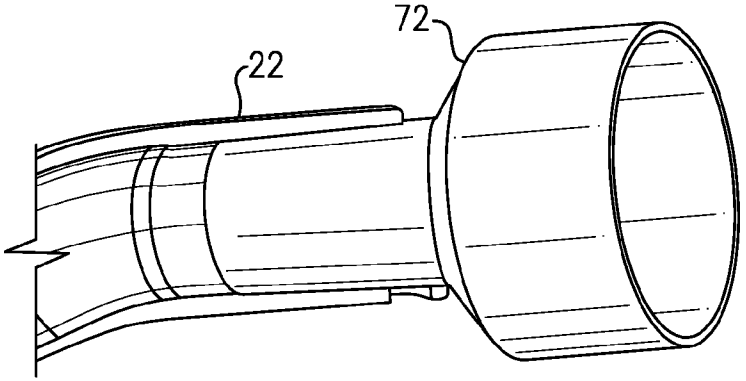
FIG. 19 is a partial cut-away view of the tool and connector of FIG. 18.

The tubular connector 22 is appropriately shaped and formed so as to be configured to be universal, and to receive either a male vacuum hose fitting or a female vacuum hose fitting, of a wide range of sizes. As seen in FIG. 17, a female vacuum hose connector or fitting 70 slips over the outer diameter of the tubular connector 22, and makes a snug interference fit. Otherwise, as shown in FIG. 18, a male vacuum hose fitting or connector 72 can slip into the inner diameter of the tubular connector 22, as shown in more detail in the cut-away view of FIG. 19. Both the inside and outside surfaces of the tubular connector can be gently tapered to achieve a snug fit relative to the associated male or female vacuum hose fitting.

Figure 20:
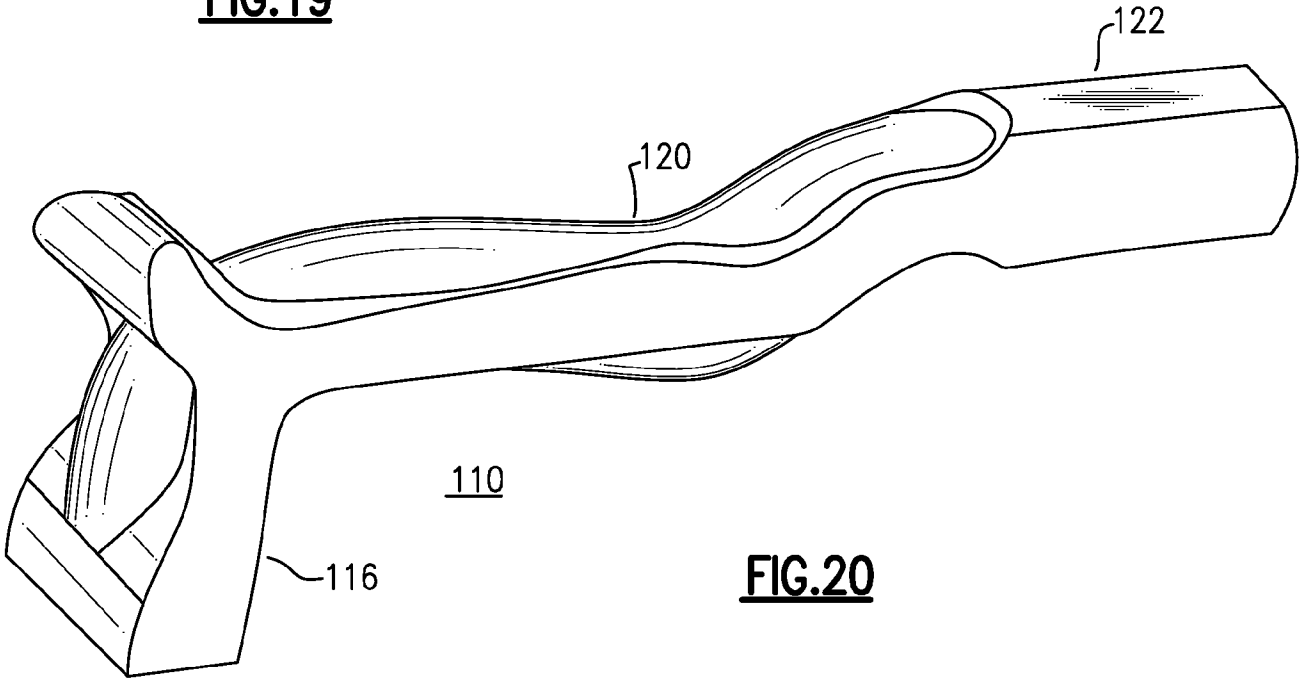
FIG. 20 is a perspective view of a possible alternative embodiment of the tool.

FIG. 20 illustrates an alternative construction of a vacuum assisted scraper 110, according to one of many possible alternative embodiments. Here the scraper 110 is shown with a head 116, handle or grip portion 120 and tubular vacuum connector 122. One or more associated scraper blade(s), either straight or curved edge, can be installed at the front of the front wall, the rear of the front wall, or the rear of the rear wall, as discussed earlier. An optional grip handle is shown here attached to a top part of the head 116. An electric vibrator (not shown) can also be incorporated into the head 116 to assist in removal of paint, varnish or other materials on the substrate.

The above and many objects, features and advantages are possible according to the principles of this invention, which is to be measured according to the appended claims.

We claim:

1. A vacuum-assist scraper tool having a head in which a scraper blade is mounted, the head having a cavity defined between front and back walls, the front and back walls converging curvedly to an intake slot opening, a hollow tubular grip portion extending proximally from the head, and a vacuum hose-accepting tubular connector extending proximally from said tubular grip portion; and said scraper tool having a plurality of blade mounting positions for attaching a scraper blade, including one or both of a first mounting position within said intake slot opening at a back surface of said front wall and a second mounting position at a rear surface of said rear wall, wherein said tool is formed of upper and lower molded halves that fit onto one another at a partition, and including a snap-together connection that includes a first portion formed on said upper half and a mating second portion formed on a mating location on the lower half; such that when assembled the first portion and second portion snap securely one into the other.

2. The vacuum-assist scraper tool of claim 1, in which the tubular connector is angled downward relative to an axis of said tubular grip portion.

3. The vacuum-assist scraper tool of claim 1, wherein the front wall of said head curves within said cavity in a continuous arc to said slot opening.

4. The vacuum-assist scraper tool of claim 3 wherein said front and back wall at said head each curve in a continuous arc and converge towards said slot opening.

5. The vacuum-assist scraper tool of claim 1 wherein said partition includes a left parting line and a right parting line each extending along a respective side of the tool and defining a juncture of said upper and lower molded halves.

6. The vacuum-assist scraper tool of claim 5 wherein a pair of longitudinal slots are formed in the lower molded half of said tool adjacent a proximal end of the tubular connector, and corresponding cleats are molded on opposite sides of the lower molded half at or near the proximal end of the tubular connector, such that the cleats are adapted to snap into the longitudinal slots, respectively, when the upper half is mounted on said lower half.

7. The vacuum-assist scraper tool of claim 1 wherein each of said plurality of blade mounting positions on said tool has a pair of standard screw openings therein configured for mounting a standard flat scraper blade.

8. The vacuum-assist scraper tool of claim 1 comprising left and right ergonomic protuberances that extend laterally outward approximately from the junction of the grip portion with the tubular connector.

9. The vacuum-assist scraper tool of claim 1 wherein the front wall of said head has a plurality of longitudinal parallel ribs formed on the interior of the head adapted for directing the flow of air within said head portion and avoiding turbulence in the air intake through said mouth.

10. The vacuum-assist scraper tool of claim 9 wherein said ribs extend partway from the front wall of said head towards the back wall of said head and are spaced from said back wall.

11. A vacuum-assist scraper tool having a head in which a scraper blade is mounted, the head having a cavity defined between front and back walls, the front and back walls converging in a continuous curved path to an intake slot opening, a hollow tubular grip portion extending proximally from the head, and a vacuum hose-accepting tubular connector extending proximally from said tubular grip portion; and said scraper tool having a plurality of blade mounting positions for attaching a scraper blade, including a first mounting position within said intake slot opening at a back surface of said front wall and a second mounting position at a rear surface of said rear wall, such that said scraper blade is held against the back surface of the front wall when in said first mounting position and is held against the back surface of the back wall when in said second mounting position; wherein each of said plurality of blade mounting positions on said tool has a pair of standard screw openings therein configured for mounting a standard flat scraper blade; and further comprising a bent scraper blade having a scraping edge on a lower portion, a bend, and an upper portion across said bend, and with a pair of mounting apertures on said upper portion permitting said bent scraper blade adapted to be mounted on the second mounting position of said plurality of positions, such that said lower portion extends at least partway across said slot in a proximal-distal direction.

12. A vacuum-assist scraper tool having a head in which a scraper blade is mounted, the head having a cavity defined between front and back walls, the front and back walls converging in a continuous curved path to an intake slot opening, a hollow tubular grip portion extending proximally from the head, and a vacuum hose-accepting tubular connector extending proximally from said tubular grip portion; and said scraper tool having a plurality of blade mounting positions for attaching a scraper blade, including a first mounting position within said intake slot opening at a back surface of said front wall and a second mounting position at a rear surface of said rear wall, such that said scraper blade is held against the back surface of the front wall when in said first mounting position and is held against the back surface of the back wall when in said second mounting position, wherein each of said plurality of blade mounting positions on said tool has a pair of standard screw openings therein configured for mounting a standard flat scraper blade, and wherein said front mounting position includes a pair of blade-support slots on left and right sides of said head, each extending to said intake slot, and defining an open area therebetween for accessing said screw openings of the front mounting position, and which support left and right portions of the blade when the same is mounted in the front mounting position.

13. A vacuum-assist scraper tool having a head in which a scraper blade is mounted, the head having a cavity defined between front and back walls, the front and back walls converging in a continuous curved path to an intake slot opening, a hollow tubular grip portion extending proximally from the head, and a vacuum hose-accepting tubular connector extending proximally from said tubular grip portion; and said scraper tool having a plurality of blade mounting positions for attaching a scraper blade, including a first mounting position within said intake slot opening at a back surface of said front wall and a second mounting position at a rear surface of said rear wall, such that said scraper blade is held against the back surface of the front wall when in said first mounting position and is held against the back surface of the back wall when in said second mounting position; the tubular connector further comprising a tab portion extending proximally from a proximal end of the tubular connector and following the curves of inner and outer surfaces of the tubular connector; said tab portion having a tool-hanging hole therein.

14. The vacuum-assist scraper tool of claim 13 wherein said tubular connector has outer and inner walls adapted to receive a female vacuum hose fitting and a male vacuum hose fitting, respectively.

* * * * *